US009635948B2

(12) United States Patent
Spaugh

(10) Patent No.: US 9,635,948 B2
(45) Date of Patent: May 2, 2017

(54) BLANKET/SHEET LIFTING DEVICE AND METHOD

(71) Applicant: Lisa M. Spaugh, Grand Rapids, MI (US)

(72) Inventor: Lisa M. Spaugh, Grand Rapids, MI (US)

( * ) Notice: Subject to any disclaimer, the term of this patent is extended or adjusted under 35 U.S.C. 154(b) by 350 days.

(21) Appl. No.: 14/223,463

(22) Filed: Mar. 24, 2014

(65) Prior Publication Data

US 2015/0265061 A1 Sep. 24, 2015

(51) Int. Cl.

| | |
|---|---|
| ***A47C 20/02*** | (2006.01) |
| ***A47C 21/02*** | (2006.01) |
| ***A61G 7/05*** | (2006.01) |
| ***A61G 13/12*** | (2006.01) |
| ***A47C 20/00*** | (2006.01) |

(52) U.S. Cl.

CPC ..... *A47C 20/021* (2013.01); *A47C 21/024* (2013.01); *A61G 7/0501* (2013.01); *A61G 13/1245* (2013.01)

(58) Field of Classification Search

CPC .. A47G 2009/1018; A47G 9/10; A47C 20/02; A47C 20/021; A47C 20/027; A47C 21/024; A61G 5/12; A61G 2005/127; A61G 2005/128; A61G 7/05; A61G 7/0501; A61G 7/065; A61G 7/07; A61G 7/075; A61G 7/0755; A61G 13/12; A61G 13/123; A61G 13/1245; A61G 13/125

USPC ..... 5/503.1–505.1, 648, 651, 655.9, 953

See application file for complete search history.

(56) References Cited

U.S. PATENT DOCUMENTS

| | | | |
|---|---|---|---|
| 51,918 | A | 1/1866 | Calderwood |
| 243,868 | A | 7/1881 | Doremus |
| 988,117 | A | 3/1911 | Leonard |
| 1,067,733 | A | 7/1913 | Hassel |
| 1,072,490 | A | 9/1913 | Oilar |
| 1,175,526 | A | 3/1916 | Jones |

(Continued)

FOREIGN PATENT DOCUMENTS

| | | |
|---|---|---|
| AU | 111326 | 9/1940 |
| GB | 2269 | 0/1912 |
| WO | 2009029100 | 3/2009 |

OTHER PUBLICATIONS

FootFree Pillow, Sleep Enhancement Products, Inc.

(Continued)

*Primary Examiner* — Robert G Santos

(57) ABSTRACT

A blanket/sheet lifter comprising a small resilient foam cushion blanket/sheet support having a flat bottom, an upwardly extending back, vertically extending sides, a front face and a top. The cushion is tall enough to accommodate the length of a user's foot, and is wide enough, such that it does not tip over readily to either side, and yet does not take up too much space on either side or below of a user's foot or feet. The bottom insufficiently long that the blanket/sheet lifter supports blankets/sheets above a person's knee, and the bottom provides a firm base such that it does not tip over front to back or back to front when positioned on its bottom; a cover for said cushion which includes pockets on the front face and sides for holding hot/cold packs. In use, the cushion rests on either its flat bottom surface or its flat back surface, depending on whether it is to be positioned adjacent the user's foot or knee.

10 Claims, 4 Drawing Sheets

(56) References Cited

U.S. PATENT DOCUMENTS 1,210,019 A 12/1916 Truman
1,211,257 A 1/1917 Thomas
1,418,501 A 6/1922 Weinshenk
1,547,879 A 7/1925 Lambert
1,577,825 A 3/1926 Jenness
1,835,798 A 12/1931 McKay
1,972,673 A 9/1934 Baird
2,095,459 A 10/1937 Tottenham
2,106,834 A 2/1938 Ewald
2,160,443 A 5/1939 Schadell
2,210,255 A 8/1940 Peevey
2,229,536 A 1/1941 Wilkich
2,235,191 A 3/1941 Arnould
2,300,898 A 11/1942 Allen
2,356,219 A 8/1944 Coffing
2,401,999 A 6/1946 Wolfe
2,524,469 A 10/1950 Orford
2,547,942 A 4/1951 Hinton
2,595,449 A 5/1952 Coffing et al.
2,598,295 A 5/1952 Pelton
2,602,171 A 7/1952 Good
2,611,139 A 9/1952 Ecklund
2,614,269 A 10/1952 Hougham
2,642,589 A 6/1953 Cobb
2,668,963 A 2/1954 Drake
2,674,750 A 4/1954 Moore
2,676,340 A 4/1954 Garriott et al.
2,710,414 A 6/1955 Emery
2,880,428 A 4/1959 Forsland
3,195,151 A 7/1965 Boyer
3,234,569 A 2/1966 Stewart
3,284,817 A 11/1966 Landwirth
3,378,861 A 4/1968 Lousberg
3,639,927 A 2/1972 Munch
3,719,185 A 3/1973 Hanes
3,742,528 A 7/1973 Munch
3,803,645 A 4/1974 Oliverius
3,808,614 A 5/1974 Reinhard
3,866,251 A 2/1975 Pounds
3,938,205 A * 2/1976 Spann ..... A47C 20/027 5/632
3,939,508 A * 2/1976 Hall ..... A47C 27/15 297/DIG. 1
3,992,733 A 11/1976 Racine
D255,854 S 7/1980 Gay
4,214,326 A * 7/1980 Spann ..... A47C 20/027 5/424
4,214,327 A 7/1980 Smith
4,233,700 A * 11/1980 Spann ..... A47C 20/027 5/632
4,259,757 A * 4/1981 Watson ..... A47G 9/10 5/637
4,286,344 A 9/1981 Ikeda
4,371,997 A * 2/1983 Mattson ..... A47C 27/081 297/DIG. 3
4,528,981 A 7/1985 Behar
4,570,275 A 2/1986 Merriman
4,603,445 A * 8/1986 Spann ..... A47C 27/146 428/131
4,607,402 A 8/1986 Pollard
4,635,306 A * 1/1987 Willey ..... A47C 3/16 5/632
4,644,599 A 2/1987 Wolcott
4,700,447 A * 10/1987 Spann ..... A47C 27/146 264/284
4,872,228 A 10/1989 Bishop
4,901,387 A * 2/1990 Luke ..... A47C 27/146 5/727
4,908,892 A * 3/1990 Michelson ..... A61G 13/12 5/621
4,967,433 A * 11/1990 Neal ..... A61G 7/05707 5/655.9
4,975,997 A 12/1990 Misiura et al.
5,007,122 A * 4/1991 Daughdrill ..... A47G 9/10 5/637
5,079,790 A * 1/1992 Pouch ..... A47C 7/021 297/DIG. 1
5,101,526 A 4/1992 Smith
5,109,872 A 5/1992 Conn
5,134,739 A 8/1992 Gaffe et al.
5,172,439 A 12/1992 Farley
5,175,899 A 1/1993 Lou
5,203,042 A 4/1993 Mason
5,269,035 A * 12/1993 Hartunian ..... A47C 20/026 5/637
5,303,435 A * 4/1994 Haar ..... A47C 27/084 5/413 AM
5,329,658 A 7/1994 Fontenot et al.
D352,847 S 11/1994 Station
5,430,901 A 7/1995 Farley
5,438,720 A 8/1995 Daneshvar
5,459,896 A * 10/1995 Raburn ..... A47C 7/021 5/652.1
5,477,866 A * 12/1995 Davenport ..... A61G 7/0755 5/648
D366,527 S * 1/1996 Paterson ..... D24/158
5,530,974 A * 7/1996 Rains ..... A47C 21/08 5/630
5,542,150 A 8/1996 Tu
5,568,660 A * 10/1996 Raburn ..... A47C 7/021 5/484
5,572,757 A 11/1996 O'Sullivan
5,603,336 A 2/1997 Shepich
5,740,571 A 4/1998 Tyra
5,745,939 A 5/1998 Flick et al.
5,978,991 A 11/1999 Miles
6,067,679 A 5/2000 Rice
6,240,581 B1 6/2001 Pender
6,249,924 B1 6/2001 Kluft
6,371,894 B1 * 4/2002 Hill ..... A63B 21/00047 128/845
6,464,622 B1 10/2002 Clark
6,496,993 B2 12/2002 Allen et al.
6,668,401 B2 12/2003 Waters
6,708,353 B2 3/2004 Han
6,782,572 B1 8/2004 Jones
6,795,990 B1 9/2004 Hutchinson
6,834,403 B1 12/2004 Elliott
6,990,699 B2 1/2006 Hedges
7,137,159 B1 11/2006 Choate
7,188,382 B1 3/2007 Taylor et al.
7,207,930 B2 4/2007 Bonutti
7,555,795 B1 7/2009 Feil
7,874,029 B2 1/2011 Alston
7,996,938 B1 8/2011 Calmes et al.
8,272,086 B1 9/2012 Calmes et al.
8,316,486 B2 11/2012 Tipperreiter
2002/0095729 A1 7/2002 Waters
2002/0170114 A1 11/2002 Wolcott
2003/0229942 A1 12/2003 Dilascio
2006/0016012 A1 1/2006 Liu
2013/0160211 A1 * 6/2013 Klein ..... A61G 13/123 5/648
2015/0265061 A1 * 9/2015 Spaugh ..... A61G 13/1245 5/505.1

OTHER PUBLICATIONS

Essential Medical Height Adjustable Blanket Support, Walgreens.
Knee Elevator Pillow, Amazon.
Duro-Med Ortho Bed Wedge, Amazon.
Blanketbooster, blanketbooster.com.
Welcome to ToeSpace, toespace.com.
The Toe Tent . . . Take a Load Off Your Feet!, thetoetent.com.
Toe Tent, SleepyTime Manufacturing, sleepytimemfg.com.
Joint Industry Foam Standards and Guidlines, Polyurethane Foam Association, Section 4.0, Published Jul. 1994.
Air Flow Foot Pillow, HWSN Healthyway Shopping Network.
Foot Tent, YouTube.
Foam Cushion Material, kimsupholstery.com.

(56) References Cited

OTHER PUBLICATIONS

Cover hover, coverhover.com.
Air Flow Foot Cushion, Carol Wright Gifts.
Foot Tent Search.

* cited by examiner

BLANKET/SHEET LIFTING DEVICE AND METHOD

BACKGROUND OF THE INVENTION

The present invention relates to blanket/sheet lifting devices and method. Such devices used to lift a portion of the blanket/sheet covering a person off of some person of the person's body. Most often, such devices lift the blanket/sheet off of the person's feet or some part of his or her body, possibly a surgical wound, break or sprain injury, skin rash or ailment. Sometimes the pressure of a blanket/sheet on the person may transmit unwanted force and painful pressure causing discomfort.

Such prior art devices most often comprise structural tent supports made of some rigid material that must be installed under the mattress, across the entire width of the bed and cannot be easily added or removed. They are often cumbersome, cold, hard and must remain in place making an unattractive bed during the daytime. They are not easily transported for use during travel. Some such devices comprise a cushion or bolster. Typically, the bolsters are quite long, and extend along the entire foot of the bed, or for a substantial distance alongside a portion of the user's body, such as the leg, taking up valuable space at the foot of the bed, where there is limited space for the average height person, or alongside the body. Sometimes they are simply a wide triangle shape, again designed for placement beyond a person's foot at the end of the bed where there is limited space for the average height person.

SUMMARY OF THE INVENTION

The blanket/sheet support of the present invention comprises a small resilient foam cushion which has a flat bottom, a flat upwardly extending back, flat vertically extending sides, a flat top surface which is shorter back to front than the bottom surface, a flat vertically extending short front face which is shorter than the back, and a rearwardly sloping front face extending from the top of the short front face to the front edge of the top surface. The cushion is tall enough to accommodate the length of a user's foot. Side to side, the cushion, including its bottom surface is wide enough, such that is does not tip over readily to either side, and yet narrow enough that it does not take up too much lateral space on either side of a user's foot or feet. Front to back, the bottom surface is sufficiently long that the blanket/sheet lifter supports blankets/sheets above a person's knee, and the bottom provides a firm base such that it does not tip over when positioned on its bottom surface. The foam is resilient but structurally firm, such that it does not deform under the weight of blankets/sheets to the point of easily tipping over in use. The preferable use of a soft cover also adds to maintaining the shape and form of the foam.

In use, the cushion rests on either its flat bottom surface or its flat back surface, depending on whether it is to be positioned adjacent the user's foot or knee. It can be used in either position on its base or its back depending on what height is desired. When positioned adjacent a user's foot, the sloping front face is oriented to face the head of the bed. Preferably, one places one of the blanket/sheet lifters on the outside of each of the user's feet, or on either side of one or both knees, when being used to protect a knee or other body part. This design also requires no space intrusion beyond the users' foot at the base of the bed and creating room for freedom of movement for the user's feet.

These and other features and advantages of the invention will be appreciated by reference to the appended drawing and description of the preferred embodiments.

DESCRIPTION OF THE PREFERRED EMBODIMENTS

Figure 1:
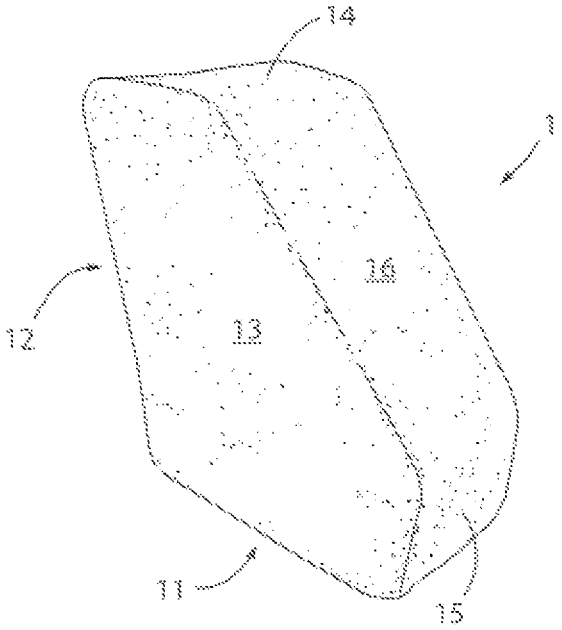
FIG. 1 is a front angled perspective view of a preferred embodiments blanket/sheet lifter.
Figure 2:
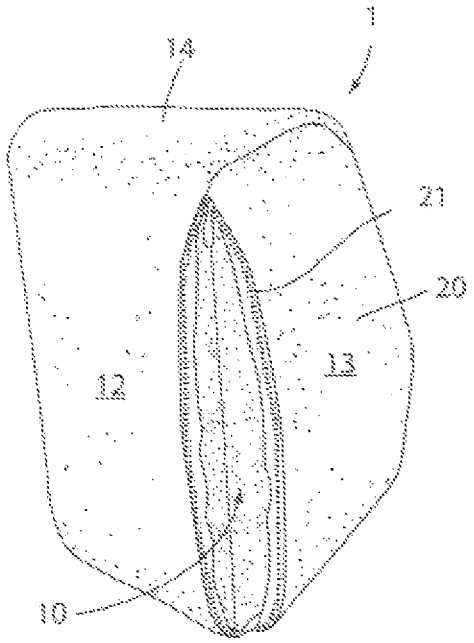
FIG. 2 is a rear angled perspective view of the blanket/sheet lifter, with its covering unzipped.
Figure 3:
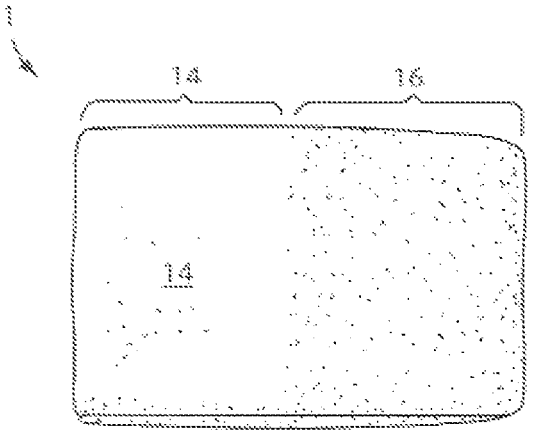
FIG. 3 is a top plan view of the preferred embodiments blanket/sheet lifter.
Figure 4:
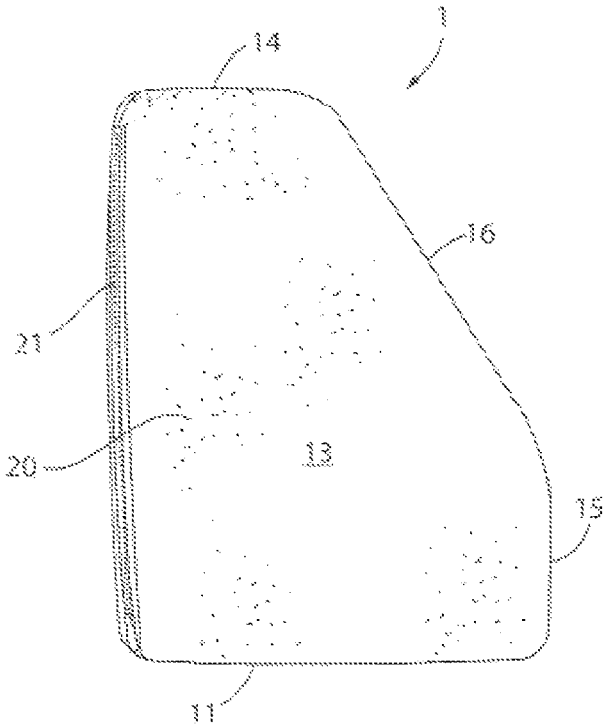
FIG. 4 is a side elevation of the blanket/sheet lifter.
Figure 5:
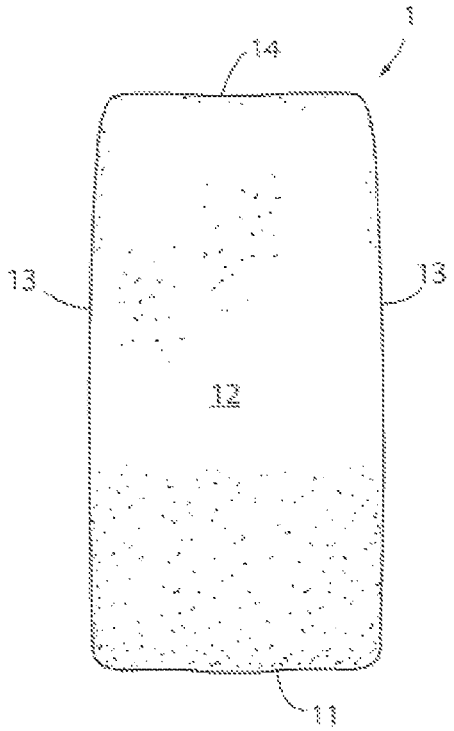
FIG. 5 is a rear elevation of the blanket/sheet lifter.

In the preferred embodiment, blanket/sheet lifter 1 includes an inner resilient but structurally firm cushion 10, covered by a soft covering 20 shaped to fit cushion snugly. (FIGS. 1-2) Cover 20 includes a corner zipper 21 which facilitates removal, cleaning and replacement of cover 20 on cushion 10. Cushion 10 defines the shape of blanket/sheet lifter 1, which has a flat bottom 11, a flat upwardly extending back 12, flat vertically extending sides 13, a flat top surface 14 which is shorter back to front than the bottom surface 11, a flat, vertically extending short front face 15 which is shorter than back 12, and upwardly and rearwardly sloping front face 16 extending from the top of the short front face 15 to the front edge of top surface 14.

The terms flat and vertical as used throughout are used in a relative or general sense, rather than as precise terms. It will be apparent to those skilled in the art that some variation from a precisely vertical or precisely flat surface are possible without departing from the spirit and function of the invention. Similarly, directional terms such as front, back, top and bottom are relative terms based on the orientation of lifter 1 as shown in the drawings.

Lifter 1, and correspondingly cushion 10, is tall enough to lift the blankets/sheets above the length of the average user's foot. Larger custom sizes are available. Side to side, the cushion 10, including bottom surface 11 wide enough, such that it does not tip over readily to either side, and yet does not take up too much lateral space on either side of a user's foot or feet. Front to back, the bottom surface 11 is sufficiently long that blanket/sheet lifter 1 supports blankets/sheets above a person's knee (FIG. 11), and bottom 11 provides a firm base such that it has fore and aft stability, and does not tip over when positioned on its bottom surface.

Preferable dimensions for blanket/sheet lifter 1 are:
Height from bottom 11 to top 14: 10-15 inches
Width from side 13 to side 13: 5-10 inches
Bottom surface front to back: 7-10 inches
Top surface front to back: 3-5 inches
Short front face, top to bottom: 3-5 inches
Sloping front face: 6-12 inches The foam material of which cushion 10 is made is sufficiently resilient and firm so as not to deform under the weight of the blankets/sheets to the point of easily tipping over in use. Variations of foam products may be used in medical/hospital applications, e.g. medical grade, closed cell or open cell foam. Medium to firm foams can be used. Foams which show an indentation load deflection rating of from 31 to 50 lbs/50 square inches are preferred, and 42-50 is most preferred. This is the pressure in pounds per a 50 square inch area required to indent the foam 25% of its height, done on a four inch thick specimen. A preferred density for foams is from 1.30 to 1.85 pounds per cubic foot, with a density of 1.4-1.5 pounds per cubic foot being more preferred.

Cover 20 for foam cushion 10 is preferably made of a soft material, and is preferably washable. A soft fleece is preferred. It is preferably anti-piling. The cover 20 must feel comforting to the user to the extent the user touches it. It includes an invisible zipper 21, preferably located on the rear corner, where back 12 and a side 13 meet, and preferably extending the full height of cover lifter 1. This facilitates removal and replacement of cover 20, for washing or the like.

Figure 6:
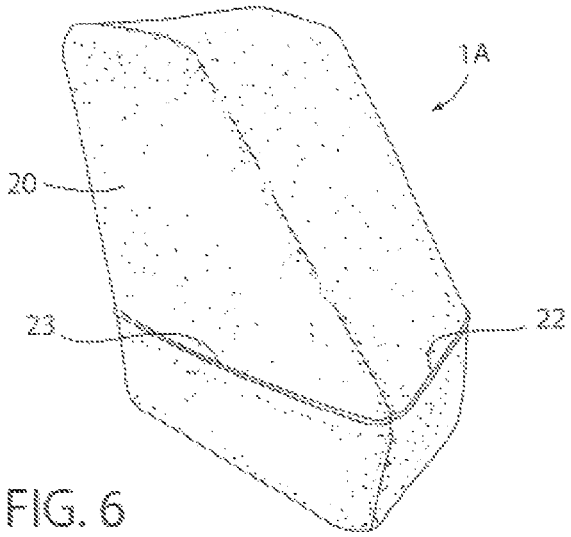
FIG. 6 is a perspective view of an alternative embodiment blanket/sheet lifter.

In the alternative embodiment blanket/sheet lifter 1A (FIG. 6), cover 20 includes a front pocket 22 and side pockets 23. Hot/Cold packs can be inserted into pockets 22 and/or 23 to apply heat or cold to an injury or reduce swelling as needed. Additionally this allows for temperature adjustments in the area immediately surrounding or touching the lifters, for hot summer or cold winter nights.

Figure 7:
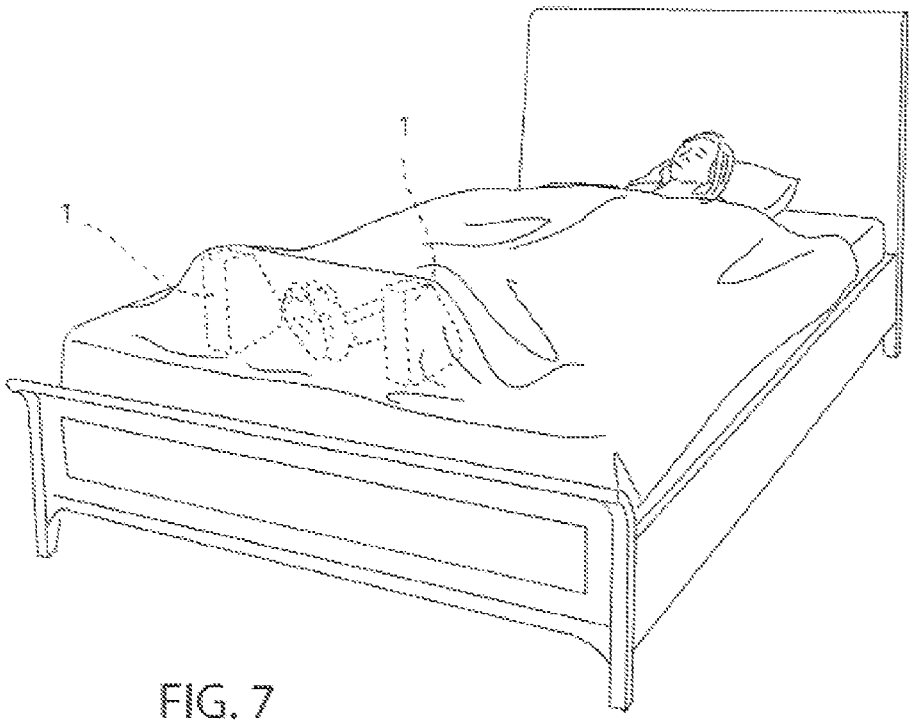
FIG. 7 is a view showing the proper position and the blankets/sheets being supported by the blanket/sheet lifters.
Figure 12:
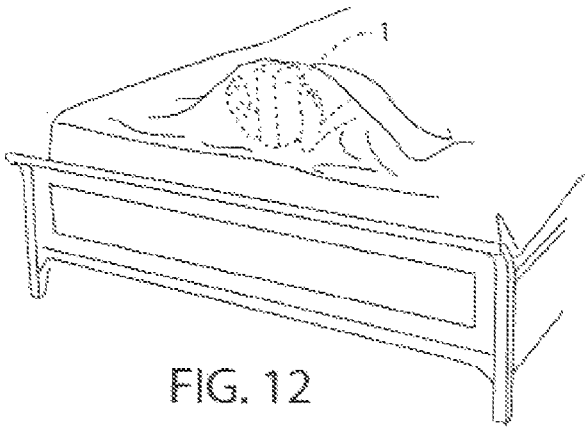
FIG. 12 is a perspective view showing a user's feet located on either side of a single blanket/sheet lifter.
Figure 10:
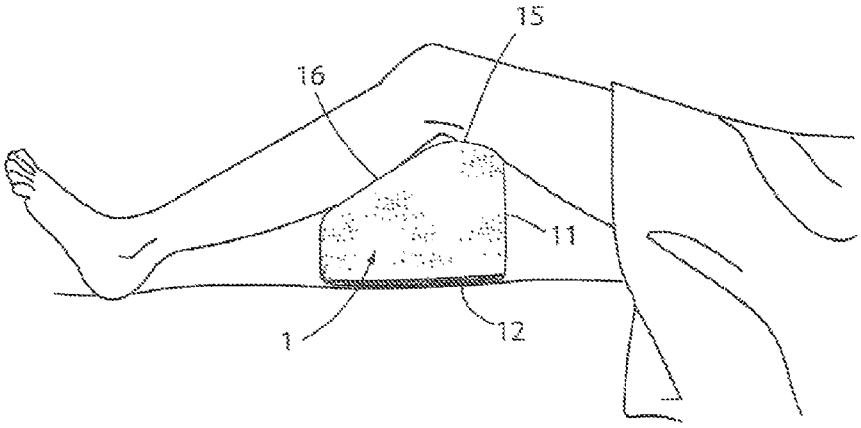
FIG. 10 is aside elevation of the blanket/sheet lifter being used as a leg support at the user's knee.
Figure 11:
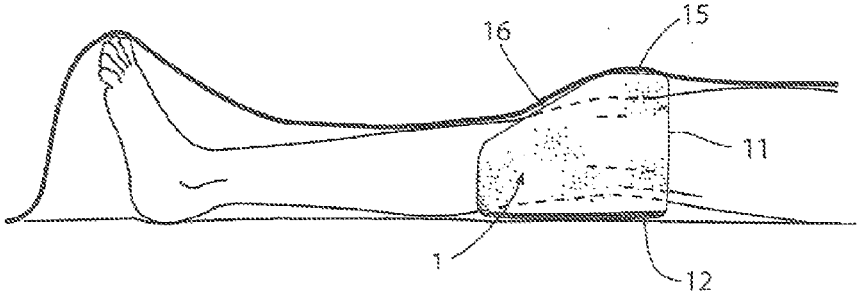
FIG. 11 is a side elevation showing the lifter positioned adjacent to a user's knee.

In use, blanket/sheet lifter 1 or 1A rests on either its flat bottom 11 or its flat back 12, depending on whether it is to be positioned on a user's resting surface adjacent the user's foot (FIG. 7) or knee (FIGS. 10 and 11). When positioned adjacent a user's foot, the sloping front face is oriented to face the head of the bed. Preferably, one places one of the blankets/sheet lifters on the outside of the user's feet (FIG. 7), or on either side of one or both knees (FIG. 11), when being used to protect a knee. Alternatively, a single lifter 1 can be placed between the user's feet, which provides a "tent like" space to either side of the lifter 1 (FIG. 12). In an alternative use, blanket/sheet lifters 1 or 1A are dimensioned to provide elevated leg support at the user's knee, as in FIG. 10. A single lifter 1 or 1A is positioned on its back surface 12, with short front face 15 located under the knee, and sloping face 16 under the calf.

Figure 8:
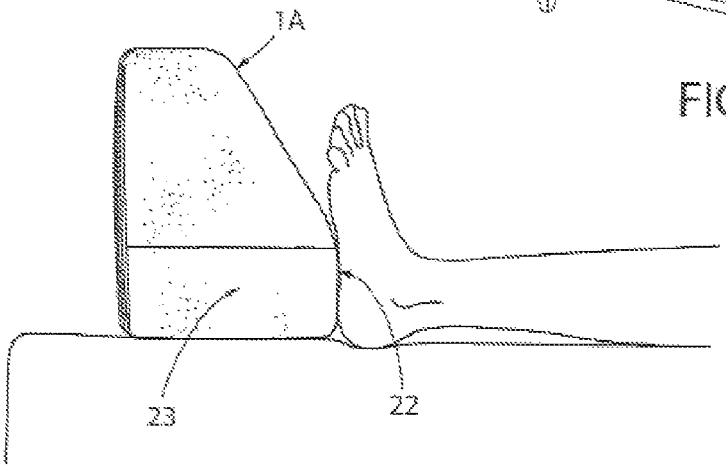
FIG. 8 shows an additional use in which the user's foot rests in a vertical orientation against the front surface of the blanket/sheet lifter.
Figure 9:
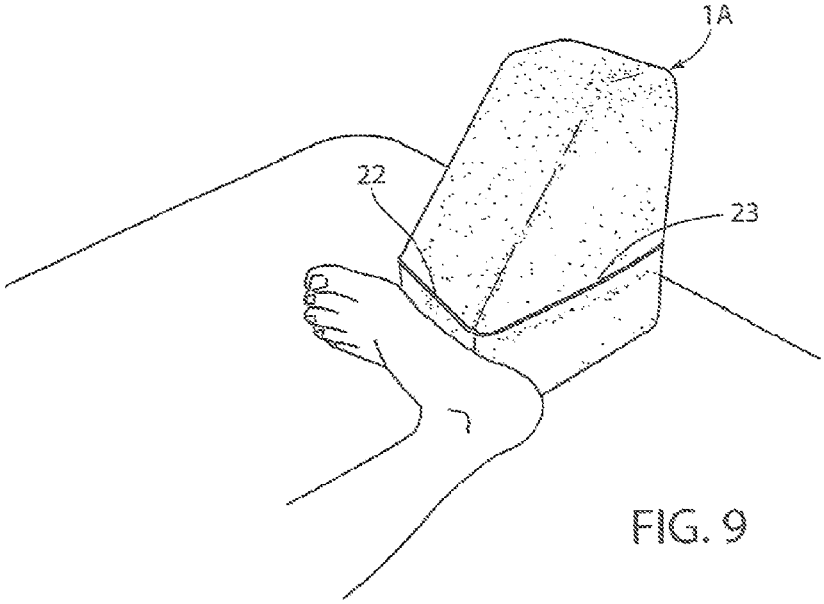
FIG. 9 is a perspective view showing a user's foot oriented sideways to the from surface of the blanket/sheet lifter.

The short front face 15 and sloping front wall 16 also make it comfortable for a user to rest the sole of his or her foot against face 15, either vertically as in FIG. 8, or horizontally as in FIG. 9. This allows for stretching of the plantar-fascia and heating or icing an injury when front pocket 22, and/or side pockets 23, is/are filled with a hot/cold packs.

Blanket/sheet lifters in accordance with the invention, including without limitation the preferred embodiment disclosed, can be used to prevent painful contact between the blankets/sheets and the feet, toes, knees or other body parts, where the user may have, for example:

a. Fibromyalgia
b. Peripheral Neuropathy
c. Plantar Fasciitis
d. Diabetes Pain
e. Arthritis/Osteoarthritis
f. Shingles Pain
g. Foot Ulcers
h. Gout
i. Restless Leg Syndrome
j. Broken or Sprained Toe/Foot/Ankle
k. In-grown Toe Nails
l. Blisters This is sampling and by no means a comprehensive list of applicable ailments that may benefit from the use of these lifters.

The use of blanket/sheet lifters of the present invention relieves the pressure/pain of bedding on surgical wounds. They can be used as elevation pad for foot, knee or hands. Pockets 22 and 23 in embodiment lifter 1A make it desirable to use the invention with hot/cold packs for relief of pain and swelling as well as for use in hot or cold weather, to condition the air in the vicinity of the feet, or other body parts.

Additionally placing the lifters on the outside of either foot will allow your foot to lean gently against them, preventing your feet from being pushed down and to the side twisting your ankles and knees in an uncomfortable and potentially painful position. Creating a space for your feet without the pressure of the blankets/sheets allows for the natural position of your foot, thereby allowing your plantar fascia to avoid shrinking and tightening overnight. An injury or wound is not a necessary requirement to find the comfort and enjoyment of the lifting device, a comfortable night's sleep for anyone will be achieved with its use.

Of course, it is understood that the forgoing are preferred embodiments, and that changes and alterations as well as additional beneficial uses can be made which are encompassed within the spirit and scope of the present invention.

The invention claimed is:

1. A blanket/sheet lifter comprising: a small resilient foam cushion blanket/sheet support having a flat bottom surface, a flat upwardly extending back, flat vertically extending sides, a flat top surface extending from said back to a front edge a distance which is shorter back to front than said flat bottom surface, a flat vertically extending short front face, extending upwardly from said flat bottom surface to a top edge a distance which is shorter than said back, and a rearwardly sloping front face extending from said top edge of said short front face to said front edge of said flat top surface; said cushion having a height from said flat bottom surface to said flat top surface of 10-15 inches in order to accommodate the length of a user's foot, said cushion having a width between said flat vertically extending sides of 5-10 inches, such that it does not tip over and yet is sufficiently narrow that it does not take up too much lateral space when placed on either side of a user's foot or feet nor along the foot of a bed; said bottom surface having a length from said short front face to said flat upwardly extending back of 7-10 inches that said blanket/sheet lifter supports blankets/sheets above a person's knee when said lifter is rotated to rest on said flat upwardly extending back, and said bottom surface provides a firm base such that said lifter does not tip over front to back or back to front when positioned on its said bottom surface.

2. The blanket/sheet lifter of claim 1 in which said foam cushion is made of foam which is resilient but structurally firm, such that it does not deform under the weight of blankets/sheets to the point of easily tipping over in use.

3. The blanket/sheet lifter of claim 2 in which said blanket/sheet lifter includes a soft, washable cover over said foam cushion.

4. The blanket/sheet lifter of claim 3 in which said cover includes a front pocket positioned on said front face of said blanket/sheet lifter, and a hot/cold pack positioned in said pocket.

5. The blanket/sheet lifter of claim 4 in which there are also pockets for hot/cold packs on one or both of said side walls of said blanket/sheet lifter.

6. The blanket/sheet lifter of claim 1 in which said cushion is made of a foam material having an indentation load deflection rating of from 31 to 50 lbs/50 square inches.

7. The blanket/sheet lifter of claim 1 in which said cushion is made of a foam material having an indentation load deflection rating of from 42 to 50 lbs/50 square inches.

8. The blanket/sheet lifter of claim 7 in which said cushion is made of foam having a density of from 1.4 to 1.5 pounds per cubic foot.

9. The blanket/sheet lifter of claim 6 in which said cushion is made of foam having a density of from 1.30 to 1.85 pounds per cubic foot.

10. The blanket/sheet lifter of claim 1 in which said cushion is made of medical grade foam.

* * * * *